US008001999B2

(12) United States Patent
Schultz

(10) Patent No.: US 8,001,999 B2
(45) Date of Patent: Aug. 23, 2011

(54) ENERGY WEAPON PROTECTION FABRIC

(75) Inventor: Gregory Russell Schultz, Marana, AZ (US)

(73) Assignee: Olive Tree Financial Group, L.L.C., Tucson, AZ (US)

( * ) Notice: Subject to any disclaimer, the term of this patent is extended or adjusted under 35 U.S.C. 154(b) by 109 days.

(21) Appl. No.: 12/205,215

(22) Filed: Sep. 5, 2008

(65) Prior Publication Data

US 2010/0058507 A1 Mar. 11, 2010

(51) Int. Cl.
*D03D 15/00* (2006.01)
*D03D 25/00* (2006.01)

(52) U.S. Cl. ..... 139/420 R; 139/383 R; 139/420 A; 139/426 R

(58) Field of Classification Search ... 2/2.5; 139/383 R, 139/420 R, 425 R, 426 R, 420 A
See application file for complete search history.

(56) References Cited

U.S. PATENT DOCUMENTS

| | | | | | |
|---|---|---|---|---|---|
| 3,454,277 | A | | 7/1969 | Mura | |
| 3,553,675 | A | | 1/1971 | Shaver et al. | |
| 3,917,891 | A | | 11/1975 | Cooke et al. | |
| 4,186,648 | A | * | 2/1980 | Clausen et al. | 89/36.02 |
| 4,292,882 | A | * | 10/1981 | Clausen | 89/36.02 |
| 4,479,999 | A | * | 10/1984 | Buckley et al. | 442/199 |
| 4,485,426 | A | | 11/1984 | Kerls | |
| 4,487,583 | A | | 12/1984 | Brucker et al. | |
| 4,557,968 | A | * | 12/1985 | Thornton et al. | 442/198 |
| 4,590,623 | A | | 5/1986 | Kitchman | |
| 4,602,385 | A | | 7/1986 | Warren | |
| 4,606,968 | A | * | 8/1986 | Thornton et al. | 442/187 |
| 4,608,716 | A | * | 9/1986 | Brumfield | 2/2.5 |
| 4,684,762 | A | | 8/1987 | Gladfelter | |
| 4,686,128 | A | | 8/1987 | Gentilman | |
| 4,714,642 | A | * | 12/1987 | McAliley et al. | 428/113 |
| 4,732,803 | A | * | 3/1988 | Smith, Jr. | 428/212 |
| 4,737,401 | A | * | 4/1988 | Harpell et al. | 442/187 |
| 4,774,148 | A | | 9/1988 | Goto | |
| 4,781,223 | A | * | 11/1988 | McAliley et al. | 139/420 R |
| 4,879,165 | A | * | 11/1989 | Smith | 428/212 |
| 4,922,969 | A | * | 5/1990 | Campman et al. | 139/408 |
| 4,943,885 | A | | 7/1990 | Willoughby et al. | |
| 4,953,234 | A | * | 9/1990 | Li et al. | 2/412 |
| 5,020,157 | A | * | 6/1991 | Dyer | 2/2.5 |
| 5,021,283 | A | * | 6/1991 | Takenaka et al. | 428/116 |
| 5,073,984 | A | | 12/1991 | Tone et al. | |
| 5,119,512 | A | * | 6/1992 | Dunbar et al. | 2/167 |
| 5,124,195 | A | * | 6/1992 | Harpell et al. | 428/152 |

(Continued)

FOREIGN PATENT DOCUMENTS

CN 2165408 5/1994

(Continued)

OTHER PUBLICATIONS

Shieldex Trading USA, *Metallized Yarns Fibers & Fabrics*, advertisement, 2006, Palmyra, NY.

(Continued)

*Primary Examiner* — Bobby H Muromoto, Jr.
(74) *Attorney, Agent, or Firm* — Stinson Morrison Hecker LLP

(57) ABSTRACT

A fabric for protecting a wearer thereof from an energy weapon. The fabric is made of a plurality of coupled strands. Bach strand is made from at least two fibers, an electrically non-conductive fiber and an electrically conductive fiber. The electrically non-conductive fiber at least partially encloses the electrically conductive fiber.

35 Claims, 8 Drawing Sheets

U.S. PATENT DOCUMENTS 5,145,734 A * 9/1992 Ito et al. 442/187
5,175,040 A * 12/1992 Harpell et al. 428/113
5,185,195 A * 2/1993 Harpell et al. 428/102
5,196,252 A * 3/1993 Harpell 428/102
5,200,263 A * 4/1993 Gould et al. 428/323
5,248,548 A 9/1993 Toon
5,349,893 A * 9/1994 Dunn 89/36.05
5,354,950 A 10/1994 Golane
5,356,700 A * 10/1994 Tanaka et al. 442/199
5,387,300 A * 2/1995 Kitamura 156/148
5,399,418 A * 3/1995 Hartmanns et al. 428/218
5,401,901 A 3/1995 Gerry et al.
5,407,612 A * 4/1995 Gould et al. 264/496
5,472,769 A 12/1995 Goerz, Jr. et al.
5,514,241 A * 5/1996 Gould et al. 156/261
5,514,457 A 5/1996 Fels et al.
5,515,541 A * 5/1996 Sacks et al. 2/2.5
5,534,343 A * 7/1996 Landi et al. 428/313.5
5,538,781 A * 7/1996 Rao et al. 442/217
5,545,455 A * 8/1996 Prevorsek et al. 428/76
5,552,208 A * 9/1996 Lin et al. 428/113
5,556,695 A * 9/1996 Mazelsky 442/203
5,578,358 A * 11/1996 Foy et al. 428/104
5,622,771 A * 4/1997 Chiou et al. 428/219
5,690,537 A 11/1997 Kalmus
5,702,994 A 12/1997 Klosel
5,736,474 A 4/1998 Thomas
5,738,925 A * 4/1998 Chaput 428/101
5,771,488 A * 6/1998 Honkala 2/2.5
5,799,329 A 9/1998 Hauschild
5,804,291 A 9/1998 Fraser
5,824,940 A * 10/1998 Chediak et al. 89/36.05
5,833,782 A * 11/1998 Crane et al. 156/60
5,855,733 A * 1/1999 Douglas et al. 156/583.1
5,888,652 A * 3/1999 Berbner et al. 428/389
5,906,004 A 5/1999 Lebby et al.
5,926,842 A * 7/1999 Price et al. 2/2.5
5,958,804 A * 9/1999 Brown et al. 442/192
5,968,854 A 10/1999 Akopian et al.
5,996,115 A * 12/1999 Mazelsky 2/2.5
6,009,789 A * 1/2000 Lyons 89/36.02
6,035,438 A * 3/2000 Neal et al. 2/2.5
6,119,575 A * 9/2000 Dragone et al. 89/36.05
6,127,035 A * 10/2000 Carter et al. 428/377
6,127,291 A * 10/2000 Coppage et al. 442/135
6,138,275 A * 10/2000 Sacks 2/2.5
6,147,018 A * 11/2000 Chiou 442/243
6,147,854 A 11/2000 Kirschner
6,151,803 A 11/2000 Charles
6,154,880 A 12/2000 Bachner, Jr.
6,162,746 A * 12/2000 Chiou 442/134
6,170,378 B1 * 1/2001 Neal et al. 89/36.05
6,210,771 B1 * 4/2001 Post et al. 428/100
6,272,781 B1 8/2001 Resnick
6,276,254 B1 * 8/2001 Cordova et al. 89/36.02
6,283,168 B1 * 9/2001 Gu et al. 139/384 R
6,332,390 B1 * 12/2001 Lyons 89/36.02
6,370,690 B1 * 4/2002 Neal 2/2.5
6,371,977 B1 4/2002 Bumbarger et al.
6,389,594 B1 * 5/2002 Yavin 2/2.5
6,475,936 B1 * 11/2002 Chiou 442/203
6,500,507 B1 * 12/2002 Fisher 428/36.1
6,510,777 B2 * 1/2003 Neal 89/36.05
6,526,862 B1 * 3/2003 Lyons 89/36.05
6,534,426 B1 * 3/2003 Chiou 442/203
6,562,435 B1 * 5/2003 Brillhart et al. 428/105
6,627,562 B1 * 9/2003 Gehring, Jr. 442/35
6,647,856 B1 * 11/2003 Neal 89/36.02
6,656,570 B1 * 12/2003 Fels et al. 428/155
6,684,404 B2 * 2/2004 Bachner et al. 2/2.5
6,705,197 B1 * 3/2004 Neal 89/36.05
6,779,330 B1 * 8/2004 Andrews et al. 57/210
6,786,126 B2 * 9/2004 Sargent 89/36.02
6,794,012 B2 9/2004 Tsotsis
6,807,891 B2 * 10/2004 Fisher 89/36.02
6,809,046 B2 * 10/2004 Velpari et al. 442/187
6,840,288 B2 * 1/2005 Zhu et al. 139/425 R
6,841,492 B2 * 1/2005 Bhatnagar et al. 442/135
6,843,078 B2 1/2005 Rock et al.
6,846,545 B2 * 1/2005 Thomas 428/85
6,846,758 B2 * 1/2005 Bhatnagar et al. 442/135
6,893,704 B1 * 5/2005 van der Loo 428/107
6,949,280 B2 * 9/2005 Brillhart et al. 428/105
6,961,227 B1 11/2005 Whiton et al.
6,962,739 B1 * 11/2005 Kim et al. 428/47
7,073,538 B2 * 7/2006 Bhatnagar et al. 139/383 R
7,077,048 B1 * 7/2006 Anderson et al. 89/36.02
7,100,490 B2 * 9/2006 Muller, Jr. 89/36.02
7,153,790 B2 * 12/2006 Bottger et al. 442/134
7,206,183 B2 4/2007 Sikes et al.
7,226,878 B2 * 6/2007 Wagner et al. 442/59
7,284,280 B2 10/2007 Schultz
7,354,877 B2 4/2008 Rosenberger et al.
7,357,982 B2 4/2008 Abe et al.
7,712,149 B2 5/2010 Baldwin
2002/0073473 A1 * 6/2002 Bachner et al. 2/2.5
2003/0033655 A1 * 2/2003 Kavesh 2/2.5
2004/0264099 A1 12/2004 Sikes et al.
2005/0042960 A1 2/2005 Yeh et al.
2005/0170221 A1 * 8/2005 Kim et al. 428/911
2006/0062944 A1 3/2006 Gardner et al.
2006/0175581 A1 8/2006 Douglas
2006/0230484 A1 * 10/2006 Schultz 2/2.5
2006/0252325 A1 * 11/2006 Matsumura et al. 442/123
2007/0010151 A1 * 1/2007 Cunningham 442/135
2007/0094760 A1 * 5/2007 Busch 2/2.5
2007/0159753 A1 7/2007 Randall et al.
2007/0163023 A1 * 7/2007 Steeman et al. 2/2.5
2007/0259704 A1 11/2007 Jung
2008/0104735 A1 * 5/2008 Howland 2/2.5
2008/0251636 A1 10/2008 Soula et al.
2008/0307553 A1 * 12/2008 Jbeili et al. 2/2.5

FOREIGN PATENT DOCUMENTS

GB 221891 9/1924
RU 2004100971 6/2005
WO WO 86/003050 5/1986
WO WO 92/11899 7/1992

OTHER PUBLICATIONS

Silverell, *EMF/EMI Shielded Tents & Shielded Pouches*, http://fine-silver-productsnet.com/emteandpo.html, 2006.

Schultz, U.S. Appl. No. 12/628,648, Staple Fiber Conductive Fabric, filed on Dec. 1, 2009.

Lin, et al., Ballistic-resistant stainless steel mesh compound non-woven fabric, *Fibers and Polymers*, vol. 9, No. 6, pp. 761-767, DOI: 10.1007/s12221-008-0119-9. Abstract only (1 p.).

International Search Report and Written Opinion dated Jan. 4, 2011 for PCT/US2010/54501, 8 pages.

Whitehead, "A Rational Response to Taser Strikes", JEMS, May 2005, downloaded from the internet at http://www.charlydmiller.com/LIB06/2005MayJEMSTaser.pdf on Mar. 4, 2011, 7 pgs.

* cited by examiner

ENERGY WEAPON PROTECTION FABRIC

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The invention relates generally to a fabric and, more particularly, to a fabric for protecting a wearer thereof from an energy weapon.

2. Description of Related Art

There are many different types of protection devices which are used by law enforcement agents, military personnel, security guards, and others to prevent incapacitation or death during performance of their jobs. For example, there are "bullet-proof" vests which typically provide protection from bullets with ballistic panels constructed from high strength fibers such as aramid or polyethylene. These vests may also include metal and/or ceramic plates for protection from blunt force trauma and high velocity projectiles. Helmets and hand-held shields are also made from ballistic resistant material for protection from ballistic missiles. There are also garments manufactured from heat resistant materials such as NOMEX® aramid, which protect individuals such as fire-fighters and race car drivers during performance of their jobs.

There are also devices that provide protection from energy weapons such as TASER® weapons manufactured by TASER International, Inc., "stun-guns," and other electrical pulse-based assault devices. TASER® weapons typically have two explosive-propelled barbs and a wire connecting each barb to a power source within a hand-held housing. When the barbs embed in a target, the target's body completes the electric circuit between the barbs and rapid, high voltage, low current electric pulses are delivered to the target from the power source, thus incapacitating the target. A "stun-gun" operates similarly, but instead of explosive propelled barbs, a "stun-gun" typically has a housing with two electrical leads projecting slightly from the housing. Thus, a "stun-gun" operator must be in close proximity to incapacitate a target.

One type of energy weapon protection device comprises a garment having two insulating panels sandwiching a conductive panel. When the barbs or leads of an energy weapon contact this device, electric current flows through the conductive panel of the protective device instead of through the target wearing the device. Thus, the device protects the target from incapacitation typically caused by an energy weapon.

BRIEF SUMMARY OF THE INVENTION

The present invention is directed toward a fabric for protecting a wearer thereof from an energy weapon. The fabric comprises a plurality of coupled strands, which are preferably woven or knit, however, it is within the scope of the invention for the strands to be coupled in any manner. Each of the strands has a first, electrically non-conductive, fiber and a second, electrically conductive, fiber which is at least partially enclosed by the first fiber. The second fiber conducts electric current from an energy weapon when the leads of the energy weapon contact, or are adjacent to, the fabric, thus protecting a wearer of the fabric from the energy weapon. The fabric is easy to manufacture because the strands may be joined in any conventional manner, such as weaving or knitting, further, the coupled strands may be easily integrated into a garment. For example, the strands may be joined to the outer surface of a ballistic missile resistant vest, or as a liner to the inner surface of a glove or shirt.

In a preferred embodiment, a third fiber made from an electrically non-conductive material is intertwined with the first fiber. The second electrically conductive fiber is at least partially enclosed by the combination of the first and third fibers. The first and third fibers may be made from any electrically non-conductive material, including heat resistant or penetration resistant materials and materials that promote moisture wicking. It is within the scope of the invention for each strand to have any number of fibers, and for each strand to be constructed from fibers of different materials.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
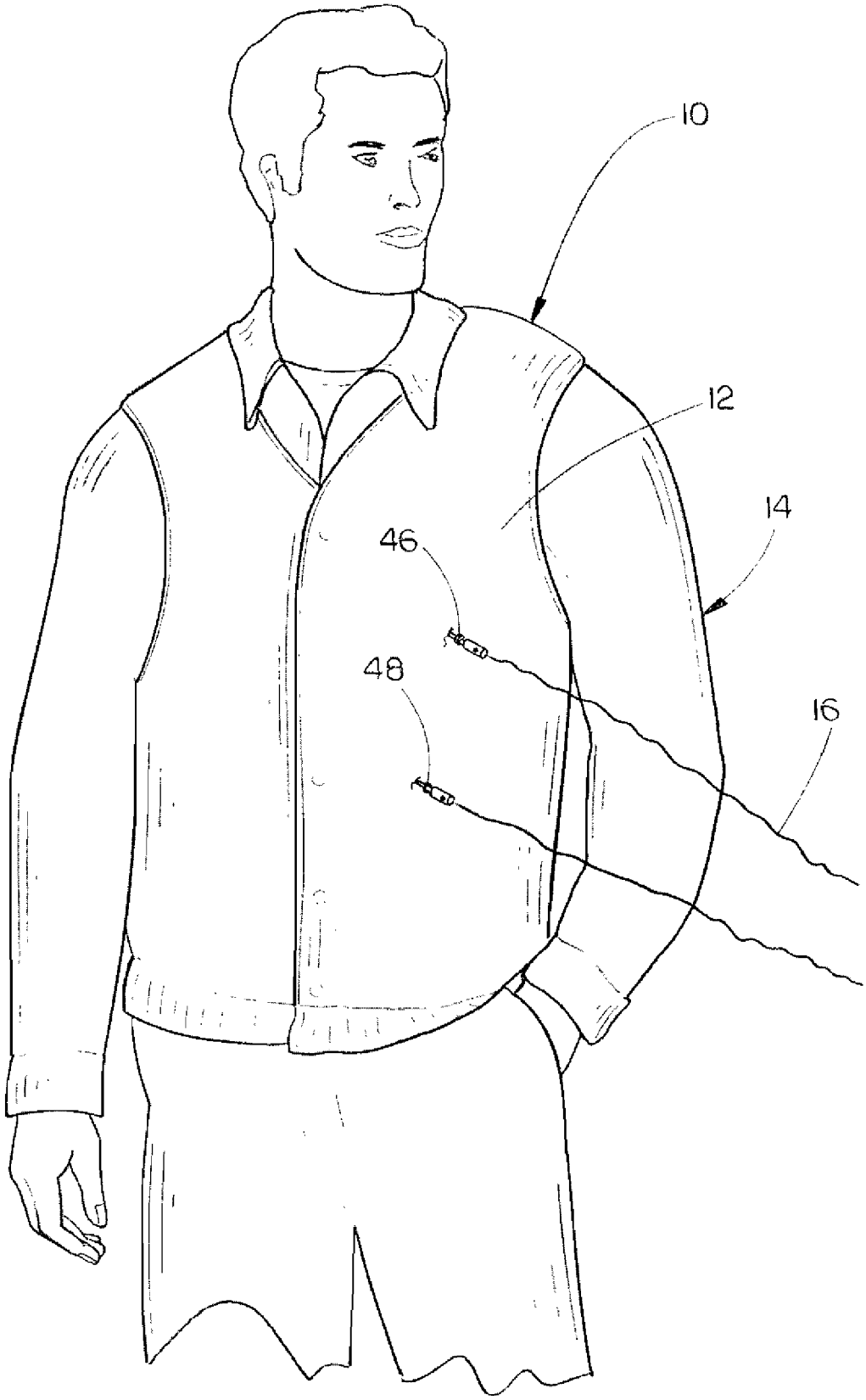
FIG. 1 is a pictorial view of a vest according to the present invention protecting the wearer thereof from the electric current generated by an energy weapon.

A vest according to one aspect of the present invention is indicated generally as 10 in FIG. 1. Vest 10 is worn upon the torso 12 of a wearer 14 for protecting the wearer from an energy weapon 16. Energy weapon 16 may be any type of energy weapon known in the art including "stun-guns" and devices manufactured by TASER International, Inc. headquartered in Scottsdale, Ariz. Vest 10 may also protect wearer 14 from heat or penetration from a ballistic missile such as a bullet or cutting instrument such as a knife. Preferably, vest 10 also wicks moisture from wearer 14. While FIG. 1 shows a vest, any type of garment configured to protect the wearer from an energy weapon is within the scope of the present invention including, but not limited to, gloves, shirts, undergarments, overcoats, pants, hats, and helmets. Further, the invention is not limited to a garment, and may consist of any of the protective fabrics described herein.

Figure 2:
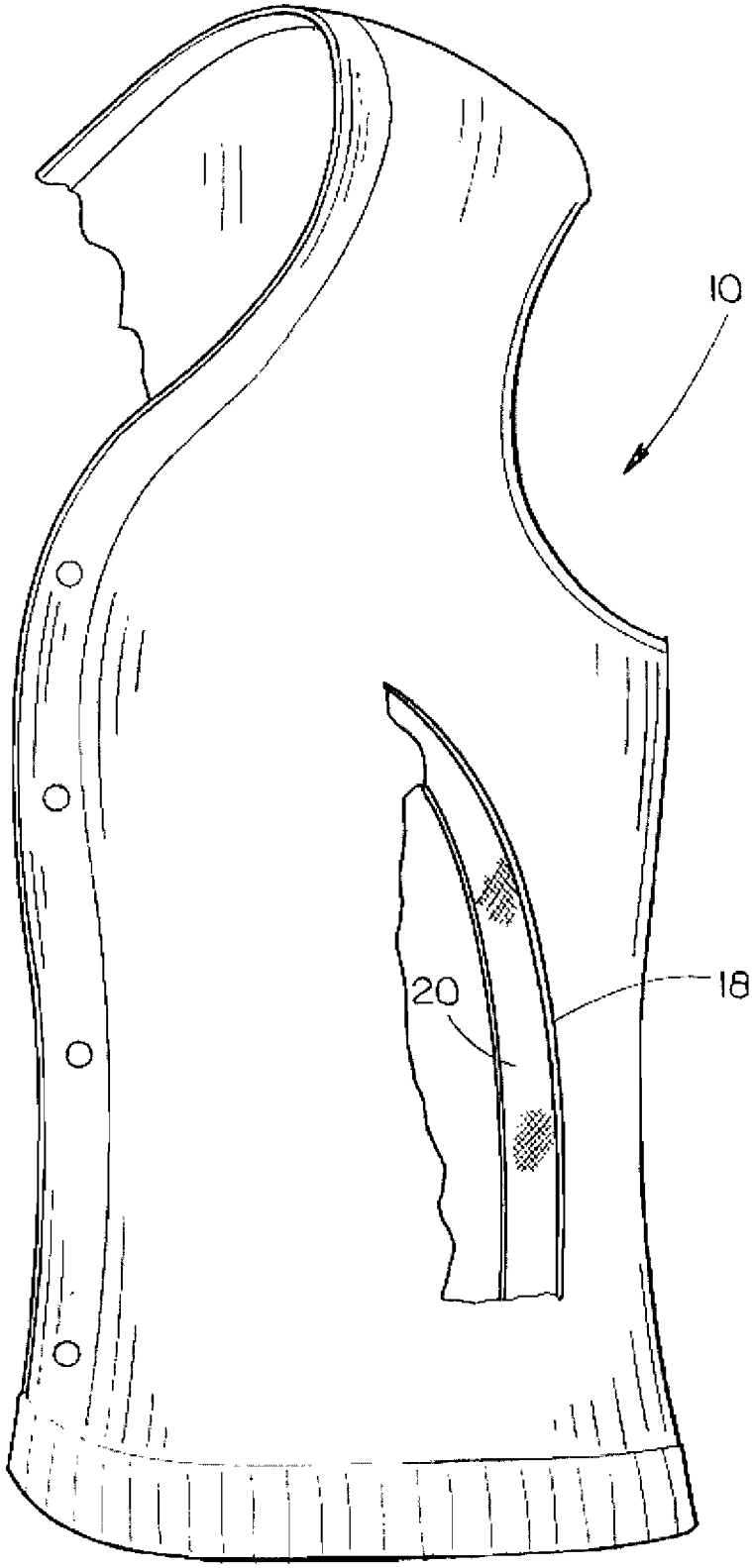
FIG. 2 is a partial cut-away view of the vest of FIG. 1 showing an outer layer and a liner of the vest.
Figure 3:
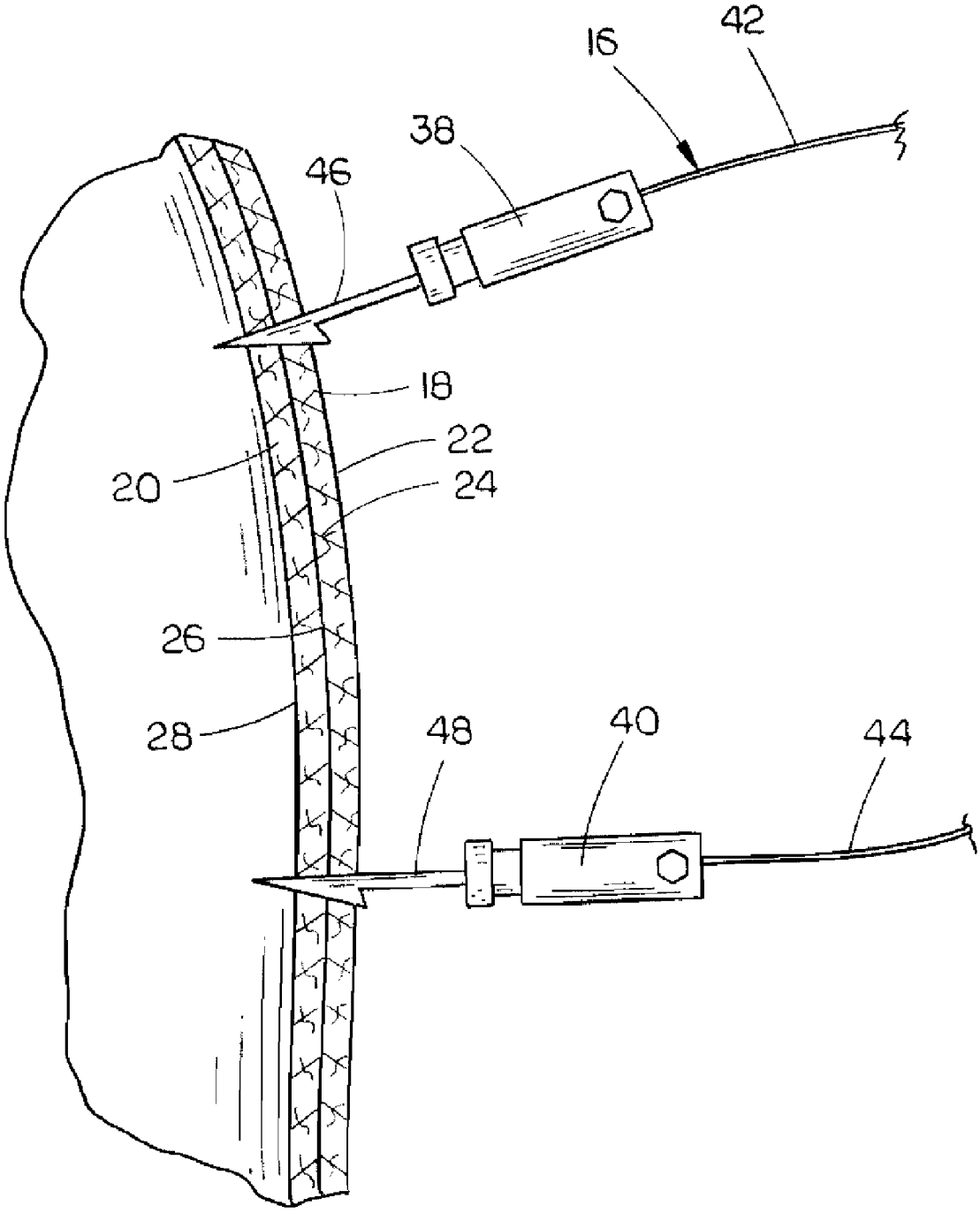
FIG. 3 is a partial cross-sectional view of the vest of FIG. 1 showing energy weapon barbs penetrating the vest.

Looking now to FIG. 2, vest 10 has an outer layer 18 and an inner layer, or liner, 20. Preferably, outer layer 18 is constructed from a first fabric and liner 20 is constructed from a second fabric, although it is within the scope of the invention for the outer layer and liner to be constructed from the same fabric. Preferably, outer layer 18 is made from a lightweight, breathable, and heat resistant material. Outer layer 18 is preferably made from cotton, but may be made from any material including but not limited to nylon, wool, polyester, polyamide, aramid, polypropylene, olefin, or any blend thereof. Additionally, it is within the scope of the invention for the outer layer 18 to be coated with a material to improve its heat resistance or resistance to electric current. As shown in FIG. 3, outer layer 18 has a front surface 22 and a rear surface 24, and liner 20 has a front surface 26 and a rear surface 28, which is adjacent the torso of wearer 14. Preferably liner 20 is stitched to outer layer 18 along seams thereof, although the liner and outer layer may be joined by any means known in the art including adhesive.

Figure 13:
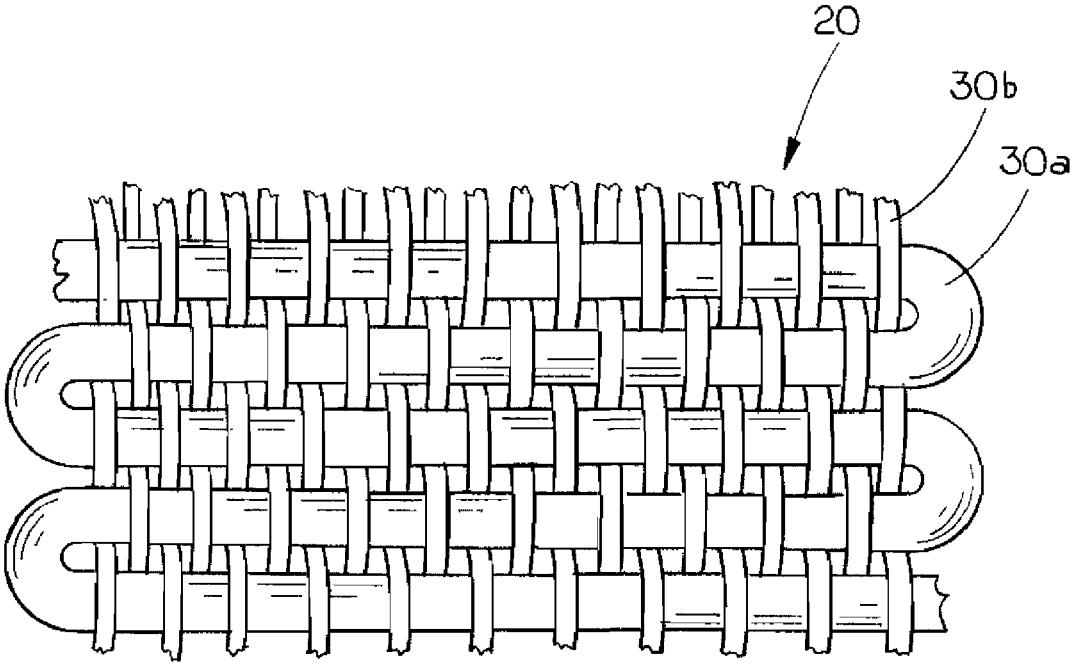
FIG. 13 is a detail view of a portion of the woven liner of the vest of FIG. 1.

Referring now to FIG. 13, liner 20 is woven by threading a weft strand 30*a* over and under alternating parallel warp strands 30*b* forming a weave commonly known as a plain weave. Weft strand 30*a* loops around the warp strands 30*b* at the sides of the fabric before threading back through the warp strands above the previous row formed by the weft strand. Although only one weft strand 30*a* is shown, it is within the scope of the invention for the liner 20 to be woven with a plurality of vertically spaced weft strands. Further, although liner 20 is shown as a plain weave, it is within the scope of the invention for the liner to be any type of weave known in the art including basket, twill, or satin. Although liner 20 is preferably woven from strands 30*a* and 30*b*, the liner 20 may also be knit from strands, such as strands 30*a* and 30*b*, or constructed by any other means known in the art for coupling strands.

Figure 4:
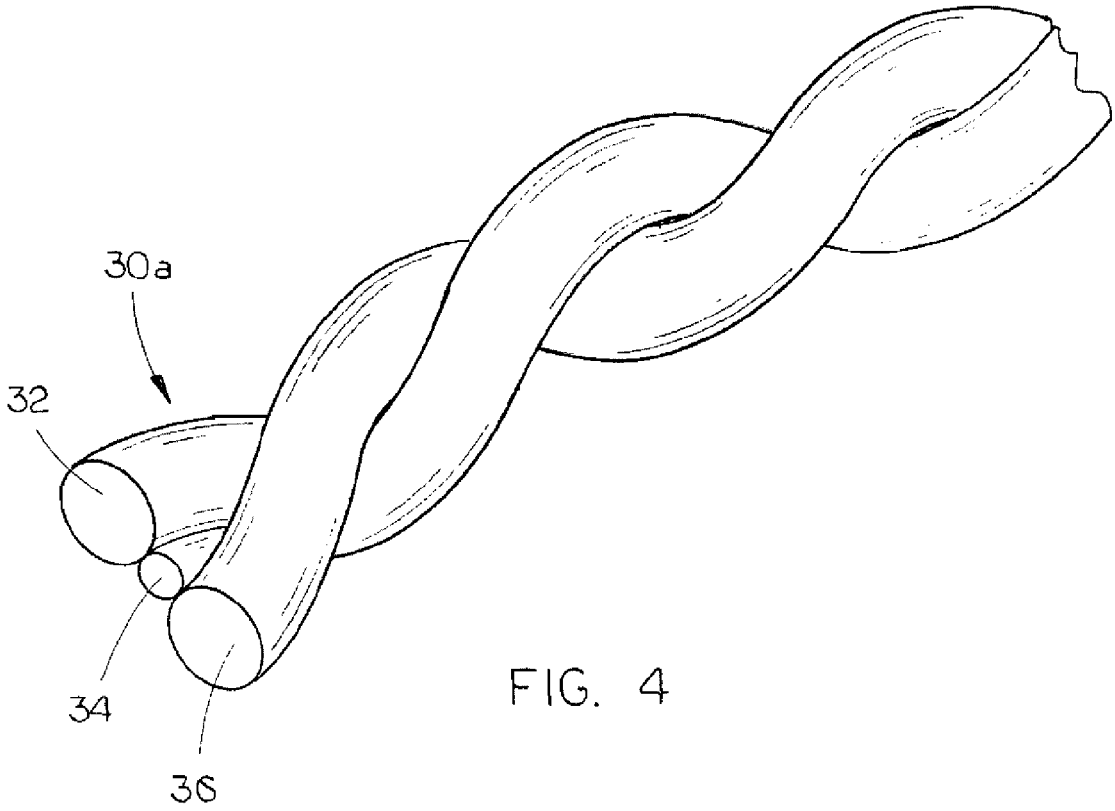
FIG. 4 is a partial perspective view of a strand of the liner of the vest of FIG. 1.

Referring now to FIG. 4, strand 30*a* has intertwined first, second, and third fibers 32, 34, and 36 respectively. Although strand 30*b* is shown in FIG. 13 with a smaller diameter than strand 30*a*, it is within the scope of the invention for the strands to be the same diameter or for strand 30*b* to have a larger diameter than strand 30*a*. Strand 30*b* preferably has the same construction as strand 30*a* and thus will not be discussed separately, however, it is within the scope of the invention for strands 30*a* and 30*b* to be formed from a different number of fibers or to be formed from different types of fibers. Additionally, it is within the scope of the invention for each of the warp and weft strands 30*a* and 30*b*, if more than one, to have a different construction. Intertwined first and third fibers 32 and 36 in combination enclose second fiber 34. Although first and third fibers 32 and 36 are shown enclosing second fiber 34, it is within the scope of the invention for a portion of second fiber 34 to be exposed such that first and third fibers 32 and 36 at least partially enclose second fiber 34. First and third fibers 32 and 36 are electrically non-conductive, while second fiber 34 is electrically conductive.

Preferably, first and third fibers 32 and 36 are cotton and polyester respectively, although it is within the scope of the invention for the first and third fibers to be any electrically non-conductive fiber such as nylon, polyester, polypropylene, olefin, wool, an aromatic polyamide fiber, commonly known as an aramid fiber, or any other type of electrically non-conductive fiber known in the art. In one embodiment of the present invention, in order to provide a penetration resistant liner 20, which can provide protection from ballistic missiles and/or cutting instruments, either or each of first and third fibers 32 and 36 is aramid formed from poly-paraphenylene terephthalamide, which is sold under the trade name KEVLAR® by E.I. du Pont de Nemours and Company ("DuPont"), or high-strength polyethylene fiber sold under the trade name SPECTRA® by Honeywell International Inc. In order to provide a heat resistant liner 20, either or each of first and third fibers 32 and 36 is aramid formed from poly(metaphenylencisophthalamide), which is sold under the trade name NOMEX® by DuPont. In order to provide a penetration resistant and heat resistant liner 20, first fiber 32 is a high strength fiber such as KEVLAR® aramid or SPECTRA® polyethylene, while third fiber 36 is a heat resistant fiber such as NOMEX® aramid. In order to provide a moisture wicking liner 20, either or each of first and third fibers 32 and 36 may be polyester. First fiber 32 may be a moisture wicking fiber such as polyester, while third fiber 36 is a high strength fiber such as KEVLAR® aramid or SPECTRA® polyethylene, or a heat resistant fiber such as NOMEX® aramid. Preferably, electrically conductive second fiber 34 is stainless steel, although it is within the scope of the invention for the fiber to be any electrically conductive material such as carbon fiber, copper, aluminum, or any blend or alloy thereof.

The majority of front and rear surfaces 26 and 28 of liner 20, shown in FIG. 3, are electrically non-conductive because electrically non-conductive first and third fibers 32 and 36 enclose electrically conductive second fiber 34, shown in FIG. 4. However, it is within the scope of the invention for portions of front and rear surfaces 26 and 28 to be electrically conductive if second fiber 34 is not completely enclosed by first and third fibers 32 and 36. Rear surface 28 is preferably electrically non-conductive to protect wearer 14 from electric current conducted by second fiber 34 and the heat generated therefrom. Front surface 26 is preferably electrically non-conductive to protect liner 20 and the wearer thereof from electric current if the liner 20 is inadvertently exposed to electric current from a power source such as a battery.

As shown in FIG. 3, energy weapon 16 has two leads 38 and 40 joined to the ends of electrically conductive wires 42 and 44. Wires 42 and 44 are electrically joined to a power source (not shown) that is operable to generate a voltage differential between the two wires. Barbs 46 and 48 are joined to leads 38 and 40 for penetrating the clothing of a target of the energy weapon 16. Energy weapon 16 has a similar configuration as any of the devices currently sold under the trade name TASER® by TASER International, Inc. Although energy weapon 16 is shown with wires, leads, and barbs, it is within the scope of the invention for vest 10 to protect wearer 14 from an energy weapon such as a "stun-gun" (not shown), which typically comprises a housing, two leads extending slightly from the surface of the housing, a power source such as a battery electrically connected to the leads, and a trigger operable to generate a voltage differential between the leads. Vest 10 protects wearer 14 from the incapacitating effects of a "stun-gun" (not shown) in the same manner as described below with respect to energy weapon 16.

Typically, when both leads of energy weapon 16 simultaneously contact, or are adjacent to, a target, the target completes the electric circuit allowing current to flow from the power source of the weapon, through one lead, through the target, through the other lead, and back to the power source. The electric current temporarily incapacitates the target. Vest 10 protects the target of energy weapon 16, because electric current flows through at least one of the electrically conductive second fibers 34 within strands 30*a* and 30*b* instead of flowing through the target. As shown in FIGS. 1 and 3, when energy weapon 16 is deployed against the wearer of vest 10, barbs 46 and 48 penetrate liner 20. If the energy weapon generates a voltage differential between wires 42 and 44, then the electric current will flow from the power source (not shown) of the energy weapon through wire 42 and barb 46, through at least one electrically conductive second fiber 34 of liner 20, through barb 48 and wire 44, and then back to the power source (not shown). Because each electrically conductive second fiber 34 within liner 20 has a much lower resistance to electric current than a human body, the electric current flows through at least one electrically conductive second fiber within liner 20 even if barbs 46 and 48 completely penetrate liner 20 and are in direct contact with wearer 14.

Vest 10 protects wearer 14 from an energy weapon, and incapacitation caused therefrom, even if only one lead of the energy weapon contacts the vest, or is directly adjacent the vest, while the other lead contacts wearer 14, or is directly adjacent the wearer. In this situation, electric current flows from the power source (not shown) through the lead of the energy weapon in direct contact with, or directly adjacent, wearer 14. Then, the current flows through the portion of the wearer between the energy lead in contact with the wearer and vest 10 until reaching at least one electrically conductive second fiber 34 of liner 20, finally, the current flows through the lead of the energy weapon in direct contact with, or directly adjacent vest 10, and back to the power source (not shown). Even though electric current flows through a portion of wearer 14, vest 10 minimizes the amount of wearer's body exposed to electric current and thus greatly reduces any incapacitation caused by the energy weapon. It should also be appreciated that the electric current may flow in the opposite direction as described above.

Vest 10 also protects wearer 14 even if barbs 46 and 48 of energy weapon 16 do not make direct contact with the liner 20, but instead are only near or adjacent the liner. For example, if barbs 46 and 48 only partially penetrate outer layer 18, electric current will arc from each of the barbs through the remainder of outer layer 18 and electrically non-conductive front surface 26 of the liner to reach at least one electrically conductive second fiber 34 within liner 20. Likewise, if a stun-gun is activated adjacent vest 10, electric current will arc from each lead of the stun gun through the electrically non-conductive outer layer 18 and front surface 26 to reach at least one electrically conductive second fiber 34 within liner 20. Thus, vest 10 prevents wearer 14 from incapacitation caused by the electric current of energy weapon 16, or a "stun-gun" (not shown). Preferably, vest 10 is operable to protect wearer 14 from an energy weapon capable of generating up to twenty-six watts of power.

Referring now to FIGS. 2 and 3, outer layer 18 and liner 20 preferably each have a thickness of approximately one-sixteenth of an inch, or a thickness approximately equal to a typical shirt or sweatshirt. Preferably, liner 20 has a weight per area of approximately 100 to 250 grams per square meter, and most preferably between 150 to 200 grams per square meter, although it is within the scope of the invention for the liner to have any weight per area. This relatively high density weave ensures that if energy weapon 16 is deployed on a wearer 14 of vest 10, the barbs 46 and 48 of the energy weapon will contact, or be adjacent to, the electrically conductive fibers 34 of multiple strands 30*a* and 30*b* within liner 20. Liner 20 is preferably woven, as shown in FIG. 13, as opposed to knit, because vest 10 need not be flexible, as most knit fabrics are, to comfortably fit wearer 14, and to reduce the percentage by weight of electrically conductive fibers. Woven fabrics require a lesser percentage by weight of electrically conductive fibers versus electrically non-conductive fibers than knit fabrics in order to effectively protect wearer 14 from energy weapon 16. It is within the scope of the invention however for liner 20 to be knit from strands such as strand 30*a*, shown in FIG. 4, in the manner shown in FIG. 12 and described below. Preferably, the electrically conductive second fiber 34 of each of strands 30*a* and 30*b* in combination is approximately 25-45% of the weight of liner 20, and most preferably approximately 30% of the weight of the liner.

Although vest 10 is shown with an outer layer 18 and a liner 20, the vest need not have an outer layer 18 to effectively protect wearer 14 from energy weapon 16. Although strand 30*a* is shown with two intertwined fibers 32 and 36 enclosing second fiber 34, the strand may have any number of fibers enclosing second fiber 34, including one fiber as shown in the alternative embodiments of FIGS. 8 and 9 and described below, or three fibers as shown in the alternative embodiment of FIG. 10 and described below.

Figure 5:
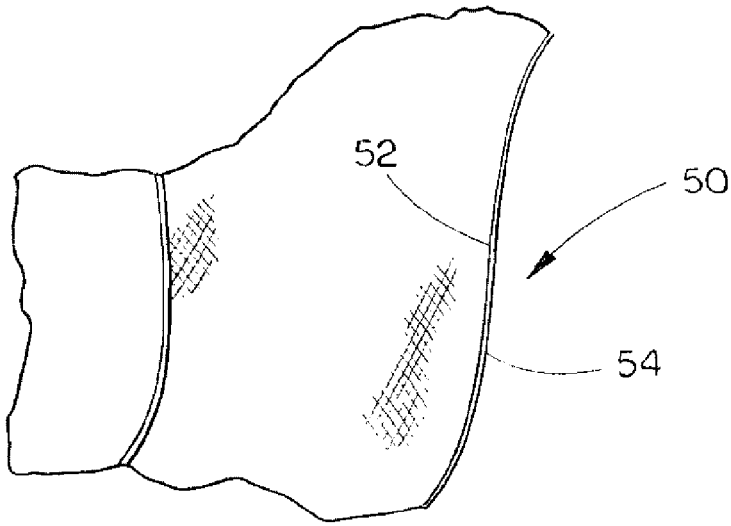
FIG. 5 is a partial perspective view of a fabric according to one embodiment of the present invention.

Looking now to FIG. 5, a fabric 50 according to one embodiment of the present invention is constructed from a plurality of joined strands, such as strand 30*a* shown in FIG. 4, preferably joined in a weave or knit. Like liner 20 described above in connection with FIGS. 1-4, each strand of fabric 50 contains at least one electrically conductive fiber, such as fiber 34 shown in FIG. 4, which protect a wearer thereof from an energy weapon in the same manner as described above in connection with liner 20 of vest 10, and at least one electrically non-conductive fiber at least partially enclosing the electrically conductive fiber. Fabric 50 has a front surface 52 and a rear surface 54 which are preferably electrically non-conductive although it is within the scope of the invention for either or both of the front and rear surfaces 52 and 54 to be electrically conductive. Fabric 50 may be incorporated into or affixed to any type of wearable garment, such as gloves, shirts, pants, overcoats, hats, helmets, body armor vests, and undergarments, or fabric 50 may be sewn as a patch onto any type of wearable garment such as those previously described. Additionally, fabric 50 may be used in any desirable manner to protect a human or animal from an energy weapon. The fibers of each strand of fabric 50 may be constructed with any of the materials described above with respect to liner 20. Further, each strand may have any number of fibers, and the strands of fabric 50 may be joined in any manner known in the art including weaving or knitting. Each strand of fabric 50 may also be constructed from different numbers of fibers or different types of fibers. Fabric 50 may also be identical to liner 20 described above in connection with FIGS. 1-4.

Figure 6:
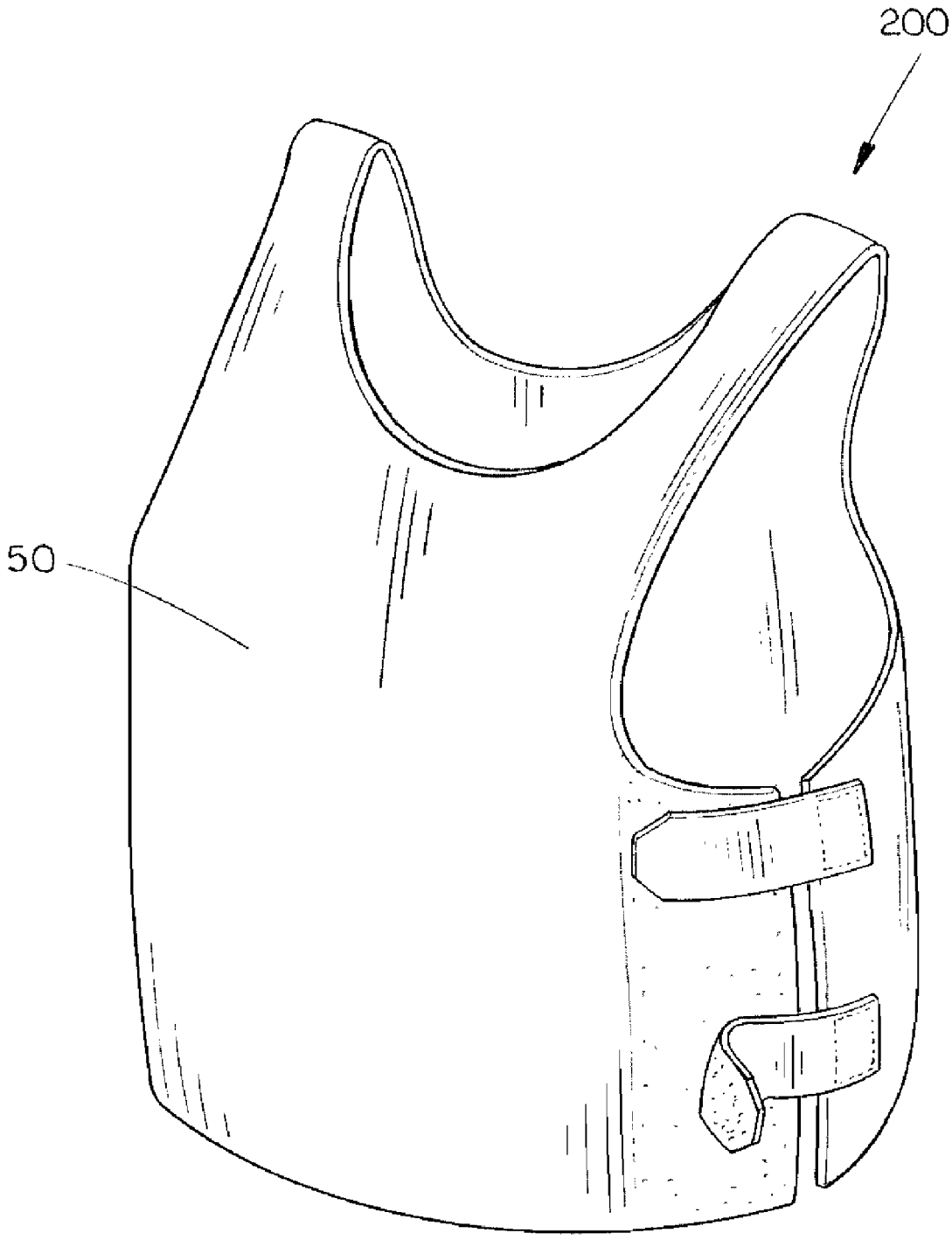
FIG. 6 is a pictorial view of a ballistic missile resistant vest according to one embodiment of the present invention.
Figure 7:
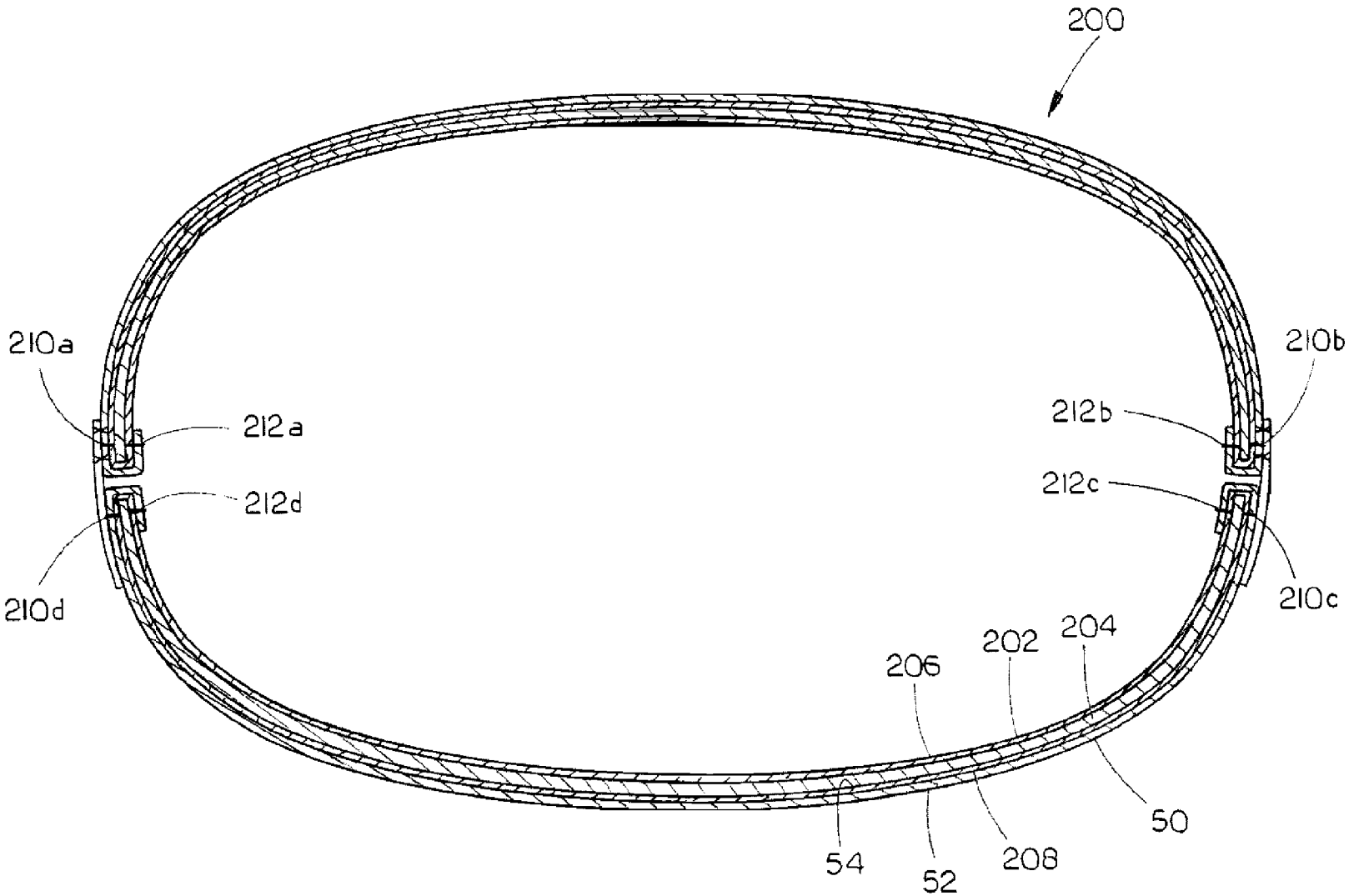
FIG. 7 is a cross-sectional view of the vest of FIG. 6.

Referring now to FIGS. 6 and 7, a body armor vest according to one aspect of the present invention is shown generally as 200. As shown in FIG. 7, vest 200 has an armor carrier 202 enclosing armor 204. Preferably, armor carrier 202 has an opening (not shown) for inserting and removing armor 204 therefrom. Preferably, a zipper or hook and loop fasteners (not shown) are joined to carrier 202 adjacent the opening (not shown) for securing the armor 204 within the carrier. Carrier 202 is preferably constructed from a lightweight, durable, flexible, breathable fabric. Carrier 202 is preferably constructed from nylon, but may be constructed from any material including but not limited to cotton, wool, polyester, polyamide, aramid, olefin, any blend thereof, or any other suitable material. Further, carrier 202 may be coated with a material to improve the heat resistance or electrical resistance of the carrier.

Armor 204 is preferably constructed from a lightweight material resistant to penetration from a ballistic missile and cutting instrument such as KEVLAR® aramid or SPECTRA® polyethylene. Carrier 202 has an inner surface 206, which is adjacent a wearer (not shown) of the vest, and an outer surface 208. Fabric 50, described above in connection with FIG. 5, is joined to outer surface 208 of carrier 202 via stitching 210*a*, 210*b*, 210*c*, and 210*d* and to inner surface 206 of carrier 202 via stitching 212*a*, 212*b*, 212*c*, and 212*d*. Although fabric 50 is shown joined to carrier 202 with stitching, it is within the scope of the invention for the fabric to be joined to the carrier using any means known in the art. Fabric 50 has a front surface 52 and a rear surface 54, which is adjacent outer surface 208 of earner 202.

As described above with respect to FIG. 5, front and rear surfaces 52 and 54 of fabric 50 are preferably electrically non-conductive and fabric 50 contains electrically conductive fibers, such as fiber 34 of strand 30, shown in FIG. 4, which protect a wearer of vest 200 from an energy weapon. As shown in FIG. 7, fabric 50 covers the entire outer surface 208 of carrier 202 to protect a wearer of vest 200 from an energy weapon, such as energy weapon 16 described above and shown in FIGS. 1 and 3, or a "stun-gun" as described above. Fabric 50 covers outer surface 208, as opposed to covering inner surface 206, so the electric current from an energy weapon contacting, or adjacent to, vest 200 need not arc through carrier 202 and armor 204 to reach fabric 50. Electric current arcing through carrier 202 and armor 204 could undesirably raise the temperature of vest 200. Fabric 50 covers a portion of the inner surface 206 of carrier 202 so that a portion of fabric 50 is adjacent a wearer of the vest. It is desirable to have a portion of fabric 50 adjacent the wearer of the vest in the situation where one lead of an energy weapon directly contacts or is adjacent the wearer and the other lead directly contacts or is adjacent the vest. In this scenario, electric current from the energy weapon can flow from the lead contacting the wearer, through the wearer and into the portion of fabric 50 adjacent the wearer without arcing through carrier 202 and armor 204. Fabric 50 only covers a portion of the inner surface 206 of carrier 202 to minimize the capacitance of vest 200. If vest 200 has a high capacitance, then electric charge stored by the vest could undesirably discharge and potentially harm a wearer thereof.

Although in the preferred embodiment of vest 200, fabric 50 only covers the outer surface 208 of the carrier 202, it is within the scope of the invention for fabric 50 to only cover the inner surface 206 of the carrier 202 in spite of the potential for electric current arcing through carrier 202 and armor 204, or for the fabric 50 to cover both the inner and outer surfaces 206 and 208 of the carrier in spite of the potential capacitive effect of such a construction. Additionally, it is within the scope of the invention for fabric 50 to only cover the outer surface 208 of carrier 202 without having any portion of the fabric adjacent the inner surface 206 of the carrier. Further, it is within the scope of the invention for patches of fabric 50 to be discretely joined to either or both of the inner and outer surfaces 206 and 208 of carrier 202 for protecting a wearer of the vest from an energy weapon. Preferably, fabric 50, when joined to a body armor vest as in FIGS. 6 and 7, comprises woven strands such as strands 30*a* and 30*b* shown in FIGS. 4 and 13. Each strand preferably includes two electrically non-conductive fibers intertwined with one electrically conductive fiber such as strand 30*a* shown in FIG. 4. The two electrically non-conductive fibers are preferably a blend of polyester and cotton, which improve the durability of the fabric when the fabric is repeatedly exposed to cleaning products.

Figure 8:
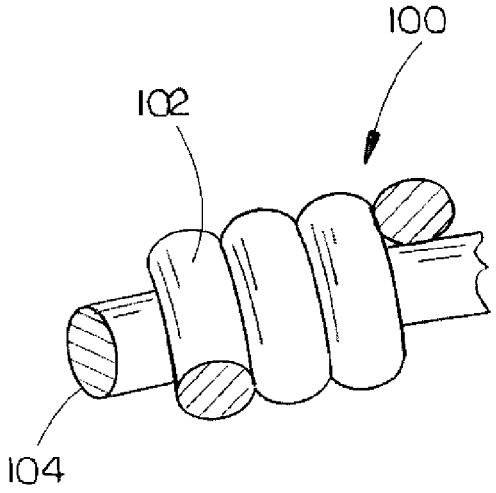
FIG. 8 is a partial perspective view of a strand of fabric according to an alternative embodiment of the present invention.

Looking now to FIG. 8, an alternative embodiment of strand 100 has a first fiber 102 encircling and enclosing a second fiber 104. First fiber 102 is preferably constructed from any of the electrically non-conductive materials described above in connection with strand 30*a*, and second fiber 104 is preferably constructed from any of the electrically conductive materials described above in connection with strand 30*a*. Strand 100 may replace either of strands 30*a* and 30*b* in the construction of liner 20, shown in FIGS. 1-4, or any of the strands of fabric 50 shown in FIG. 5.

Figure 9:
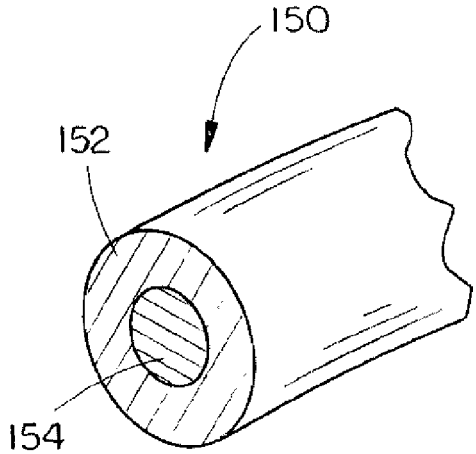
FIG. 9 is a partial perspective view of a strand of fabric according to another alternative embodiment of the present invention.

FIG. 9 shows an alternative embodiment of strand 150 which may replace either of strands 30*a* and 30*b* in the construction of liner 20, shown in FIGS. 1-4, or any of the strands of fabric 50 shown in FIG. 5. Strand 150 has a first fiber 152 with a hollow core, and a second fiber 154 positioned within the hollow core of first fiber 152. First fiber 152 is preferably constructed from any of the electrically non-conductive materials described above in connection with strand 30*a*, and second fiber 154 is preferably constructed from any of the electrically conductive materials described above in connection with strand 30*a*.

Figure 10:
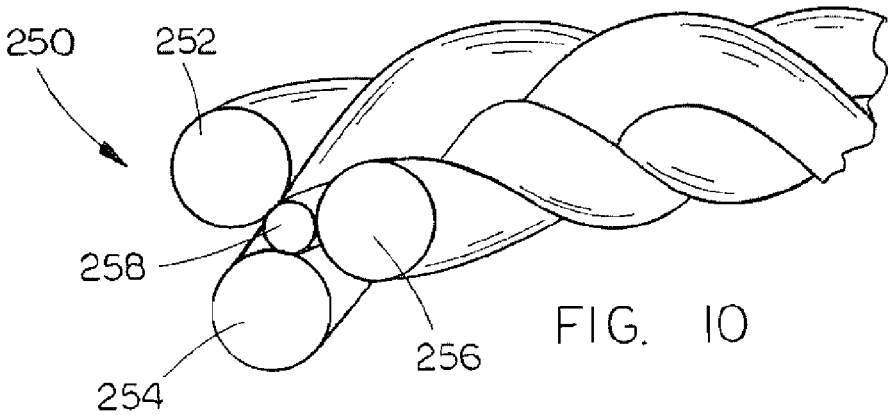
FIG. 10 is a partial perspective view of a strand of fabric according to another alternative embodiment of the present invention.

Looking now to FIG. 10, an alternative embodiment of strand 250 has three intertwined fibers 252, 254, and 256 which in combination enclose a fourth fiber 258. Fibers 252, 254, and 256 are preferably constructed from any of the electrically non-conductive materials described above in connection with strand 30*a*, and fiber 258 is preferably constructed from any of the electrically conductive materials described above in connection with strand 30*a*. In one embodiment of strand 250, fiber 252 is a heat resistant material such as NOMEX® aramid, fiber 254 is a material that promotes moisture wicking such as polyester, fiber 256 is a ballistic missile and penetration resistant material such as KEVLAR® aramid or SPECTRA® polyethylene, and fiber 258 is an electrically conductive material such as stainless steel. Strand 250 may replace either of strands 30*a* and 30*b* in the construction of liner 20, shown in FIGS. 1-4, or any of the strands of fabric 50 shown in FIG. 5.

Figure 11:
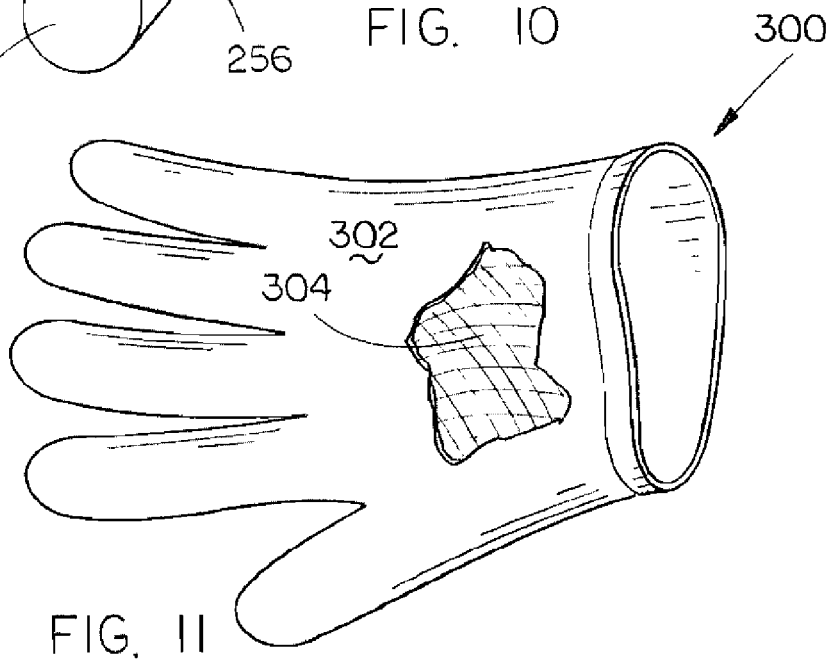
FIG. 11 is a pictorial view of a glove according to one embodiment of the present invention.
Figure 12:
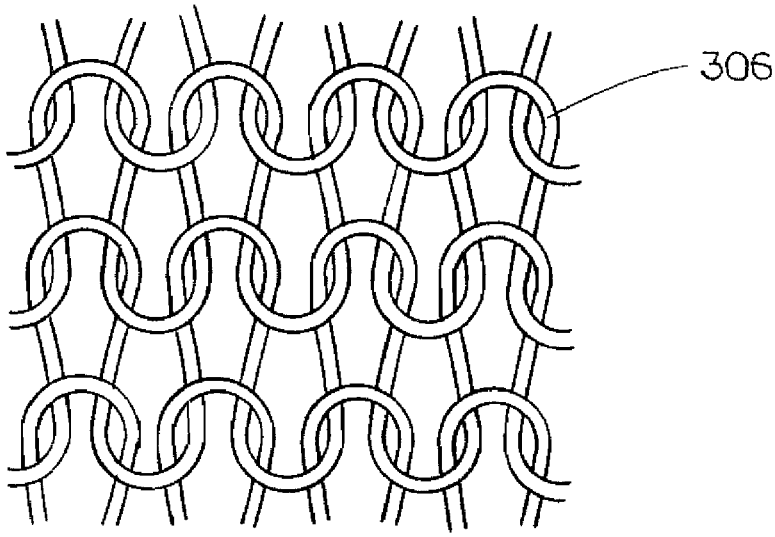
FIG. 12 is a detail view of a portion of the knit liner of the glove of FIG. 11.

Referring now to FIG. 11, a glove according to an alternative embodiment of the present invention is indicated generally as 300. Glove 300 has an outer layer 302 and an inner layer or liner 304. Outer layer 302 is preferably knit from a material such as cotton or wool, however it is within the scope of the invention for outer layer 302 to be woven and for the outer layer to be constructed from any material such as nylon, polyester, polyamide, aramid, polypropylene, or olefin. Outer layer 302 and inner layer 304 are preferably joined by stitching (not shown) although it is within the scope of the invention for the two layers to be joined by any means known in the art. Inner layer 304 is preferably knit from a plurality of identical strands 306, as shown in FIG. 12, however it is within the scope of the invention for the inner layer 304 to be woven or made from non-identical strands. Each strand 306 of inner layer 304 is preferably constructed in the same manner as strand 30*a*, shown in FIG. 4, but may also be constructed like strands 100, 150, or 250 shown in FIGS. 8, 9, and 10 respectively and described above. Preferably, the electrically non-conductive fibers are cotton to improve the comfort of glove 300, however it is within the scope of the invention for the electrically non-conductive fibers to be any of the fibers discussed above in connection with liner 20, shown in FIGS. 1-4. Likewise, it is within the scope of the invention for the electrically conductive fibers to be any of the fibers discussed above in connection with liner 20.

Liner 304 has a weight per area of approximately 250 to 300 grams per square meter, and most preferably 287 grams per square meter. Liner 304 is preferably knit, as opposed to woven, because a glove is preferably flexible in order to fit comfortably upon the hand of a wearer thereof. A liner according to the present invention constructed for a sock would also preferably be knit for the increased flexibility over that of a woven fabric. Preferably, the electrically conductive fibers of liner 304 are approximately 30 to 50% of the weight of the liner, and most preferably approximately 40% of the weight of the liner. The electrically conductive fibers for a knit liner according to the present invention preferably represent a greater percentage of the weight of a garment according to the present invention than a woven liner because the spacing between the adjacent strands 306 of a knit fabric, shown in FIG. 12, is typically greater than the spacing between the adjacent strands 30*a* and 30*b* of a woven fabric, shown in FIG. 13. Therefore, it is desirable to have larger electrically conductive fibers in a knit fabric to ensure that if an energy weapon is deployed on a wearer of the knit fabric, then the leads of the energy weapon will contact multiple electrically conductive fibers within the liner.

In operation, a user dons vest 10, fabric 50, vest 200, or glove 300, shown in FIGS. 1, 5, 6, and 11 respectively, for protection from an energy weapon, such as weapon 16, shown in FIG. 1. If the user is subjected to a voltage differential between the two leads 38 and 40 of the energy weapon, shown in FIG. 3, then the electrically conductive fiber 34 of each strand 30*a* and 30*b* of vest 10, the electrically conductive fibers of fabric 50, the electrically conductive fibers of vest 200, or the electrically conductive fibers of strands 306 of glove 300 conduct the electric current flowing from one lead of the energy weapon to the other lead of the energy weapon. Because the combination of the electrically conductive fibers within the vest 10, fabric 50, vest 200, or glove 300 has a much lower electrical resistance than a human body, no electrical current flows through the wearer of the vest, fabric, or glove.

Further, as described above, even if only one barb 46 or 48 of energy weapon 16 contacts or is adjacent the vest, fabric, or glove, while the other barb 46 or 48 contacts or is directly adjacent the target of the weapon, electric current will flow from the barb contacting or adjacent the target through the portion of the target between the barb and the vest 10, fabric 50, vest 200, or glove 300. Then the current flows into the electrically conductive fibers of the vest, fabric, or glove, and into the barb adjacent the vest, fabric, or glove. Thus, vest 10, fabric 50, vest 200, or glove 300 minimizes the incapacitating effect of an energy weapon by minimizing the distance that electric current flows through the target's body before the electric current reaches the conductive fibers of the vest, fabric, or glove. It is within the scope of the invention for vest 10, fabric 50, vest 200, or glove 300 to protect the wearer thereof from both penetrating energy weapons, such as weapon 16 shown in FIGS. 1 and 3, and non-penetrating energy weapons (not shown), such as a device described above and typically referred to as a "stun-gun."

Vest 10, fabric 50, vest 200, and glove 300, when fabricated with heat resistant fibers, penetration resistant fibers, or fibers that promote moisture wicking also protect the wearer thereof from heat, a ballistic missile such as a bullet, a knife, and provide increased comfort to the wearer by wicking away perspiration. Further, armor 204 of vest 200 provides increased protection to the wearer thereof from penetration from a ballistic missile or cutting instrument.

From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

The invention claimed is:

1. A fabric for protecting a wearer thereof from an energy weapon, comprising:

a plurality of woven or knit strands having a weight per area of approximately 100 to 300 grams per square meter, wherein each of said strands comprises first and second fibers, said first fiber comprising an electrically non-conductive material and said second fiber comprising an electrically conductive material, wherein said first fiber at least partially encloses said second fiber, and wherein said electrically conductive second fiber of each of said strands in combination is approximately 25% to 50% of the weight of said plurality of strands.

2. The fabric of claim 1, wherein said first fiber is heat resistant.

3. The fabric of claim 2, wherein said first fiber comprises aramid.

4. The fabric of claim 1, wherein said first fiber is penetration resistant.

5. The fabric of claim 4, wherein said first fiber comprises aramid.

6. The fabric of claim 4, wherein said first fiber comprises polyethylene.

7. The fabric of claim 1, wherein said first fiber promotes wicking.

8. The fabric of claim 7, wherein said first fiber comprises polyester.

9. The fabric of claim 1, wherein each of said strands further comprises a third fiber intertwined with said first fiber, wherein said third fiber comprises an electrically non-conductive material, and wherein said second fiber is at least partially enclosed by the combination of said first and third fibers.

10. The fabric of claim 9, wherein said first fiber is heat resistant and said third fiber is penetration resistant.

11. The fabric of claim 10, wherein said first and third fibers comprise aramid.

12. The fabric of claim 9, wherein said second fiber comprises stainless steel.

13. The fabric of claim 12, wherein said first fiber comprises cotton and said third fiber comprises polyester.

14. The fabric of claim 9, wherein said second fiber comprises carbon.

15. The fabric of claim 9, wherein each of said first and third fibers have a diameter that is between 25 to 50% larger than a diameter of said second fiber.

16. The fabric of claim 1, wherein said woven or knit strands in combination comprise front and rear surfaces, wherein said second fiber of each of said strands is configured to conduct an electric current from the energy weapon when the energy weapon is adjacent at least one of said front and rear surfaces.

17. The fabric of claim 16, wherein at least a portion of each of said front and rear surfaces is generally electrically non-conductive such that the electric current arcs from the energy weapon to said second fiber of at least one of said strands through said at least one surface adjacent said energy weapon.

18. The fabric of claim 1, wherein the combination of said second fiber of each of said strands is configured to protect the wearer from the energy weapon when the energy weapon delivers up to twenty-six watts of power to said strands.

19. The fabric of claim 1, wherein said strands are woven, wherein said woven strands have a weight per area of approximately 100 to 250 grams per square meter, and wherein said electrically conductive second fiber of each of said strands in combination is approximately 25% to 45% of the weight of said plurality of strands.

20. The fabric of claim 1, wherein said strands are knit, wherein said knit strands have a weight per area of approximately 250 to 300 grams per square meter, and wherein said electrically conductive second fiber of each of said strands in combination is approximately 30% to 50% of the weight of said plurality of strands.

21. A garment for protecting a wearer thereof from an energy weapon, comprising:

a fabric comprising a plurality of woven or knit strands having a weight per area of approximately 100 to 300 grams per square meter, wherein each of said strands comprises first and second fibers, said first fiber comprising an electrically non-conductive material and said second fiber comprising an electrically conductive material, wherein said first fiber at least partially encloses said second fiber, and wherein said electrically conductive second fiber of each of said strands in combination is approximately 25% to 50% of the weight of said plurality of strands.

22. The garment of claim 21, wherein said fabric comprises a rear surface generally adjacent the wearer and a front surface, and further comprising a second fabric coupled to said fabric such that said front surface of said fabric is adjacent said second fabric.

23. The garment of claim 21, wherein the garment comprises a ballistic missile resistant vest, said fabric comprises a rear surface and a front surface, and further comprising a second fabric coupled to said fabric such that said rear surface of said fabric is adjacent said second fabric.

24. The garment of claim 23, wherein said second fabric further comprises an inner surface generally adjacent the wearer and an outer surface, and wherein said fabric is coupled to said outer surface of said second fabric and at least a portion of said inner surface of said second fabric.

25. The garment of claim 21, wherein said fabric is configured to protect a hand of the wearer, wherein said strands are knit, wherein said knit strands have a weight per area of approximately 250 to 300 grams per square meter, and wherein said electrically conductive second fiber of each of said strands in combination is approximately 30% to 50% of the weight of said plurality of strands.

26. The garment of claim 21, wherein said fabric is configured to protect the torso of the wearer, wherein said strands are woven, wherein said woven strands have a weight per area of approximately 100 to 250 grams per square meter, and wherein said electrically conductive second fiber of each of said strands in combination is approximately 25% to 45% of the weight of said plurality of strands.

27. A fabric for protecting a wearer thereof from an energy weapon, comprising:

a plurality of woven or knit strands having a weight per area of approximately 100 to 300 grams per square meter, wherein each of said strands comprises first, second, and third fibers, said first and third fibers comprising an electrically non-conductive material and said second fiber comprising an electrically conductive material, wherein said first and third fibers in combination at least partially enclose said second fiber, and wherein said electrically conductive second fiber of each of said strands in combination is approximately 25% to 50% of the weight of said plurality of strands.

28. The fabric of claim 27, wherein each of said strands further comprises a fourth fiber intertwined with said first and third fibers, wherein said fourth fiber comprises an electrically non-conductive material, and wherein said second fiber is at least partially enclosed by the combination of said first, third, and fourth fibers.

29. The fabric of claim 28, wherein said first and third fibers comprise aramid, said second fiber comprises stainless steel, and said fourth fiber comprises polyester.

30. The fabric of claim 27, wherein said strands are woven, wherein said woven strands have a weight per area of approximately 100 to 250 grams per square meter, and wherein said electrically conductive second fiber of each of said strands in combination is approximately 25% to 45% of the weight of said plurality of strands.

31. The fabric of claim 27, wherein said strands are knit, wherein said knit strands have a weight per area of approximately 250 to 300 grams per square meter, and wherein said electrically conductive second fiber of each of said strands in combination is approximately 30% to 50% of the weight of said plurality of strands.

32. The fabric of claim 19, wherein said woven strands have a weight per area of approximately 150 to 200 grams per square meter, and wherein said electrically conductive second fiber of each of said strands in combination is approximately 30% of the weight of said plurality of strands.

33. The fabric of claim 20, wherein said knit strands have a weight per area of approximately 287 grams per square meter, and wherein said electrically conductive second fiber of each of said strands in combination is approximately 40% of the weight of said plurality of strands.

34. The garment of claim 25, wherein said knit strands have a weight per area of approximately 287 grams per square meter, and wherein said electrically conductive second fiber of each of said strands in combination is approximately 40% of the weight of said plurality of strands.

35. The garment of claim 26, wherein said woven strands have a weight per area of approximately 150 to 200 grams per square meter, and wherein said electrically conductive second fiber of each of said strands in combination is approximately 30% of the weight of said plurality of strands.

* * * * *